US010754281B2

(12) United States Patent
Sudo

(10) Patent No.: US 10,754,281 B2
(45) Date of Patent: Aug. 25, 2020

(54) FIXING BELT, FIXING DEVICE, IMAGE FORMING APPARATUS, AND IMAGE FORMING METHOD CAPABLE OF COPING WITH BOTH LOW GLOSSINESS AND HIGH GLOSSINESS

(71) Applicant: Konica Minolta, Inc., Tokyo (JP)

(72) Inventor: Susumu Sudo, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/657,683

(22) Filed: Oct. 18, 2019

(65) Prior Publication Data

US 2020/0150568 A1 May 14, 2020

(30) Foreign Application Priority Data

Nov. 9, 2018 (JP) ..... 2018-211584

(51) Int. Cl.
*G03G 15/20* (2006.01)

(52) U.S. Cl.
CPC ..... *G03G 15/2057* (2013.01); *G03G 15/2039* (2013.01); *G03G 15/2064* (2013.01); *G03G 2215/2038* (2013.01)

(58) Field of Classification Search
CPC ..... G03G 15/2039; G03G 15/2057; G03G 15/2064
USPC ..... 399/69, 329, 333
See application file for complete search history.

(56) References Cited

U.S. PATENT DOCUMENTS 6,983,119 B2 * 1/2006 Nakayama ..... G03G 15/2064 399/329
10,558,159 B2 * 2/2020 Yoshie et al. ..... G03G 15/2039

FOREIGN PATENT DOCUMENTS

JP 2005173259 A 6/2005
JP 2010211080 A 9/2010

* cited by examiner

*Primary Examiner* — William J Royer
(74) *Attorney, Agent, or Firm* — Lucas & Mercanti, LLP

(57) ABSTRACT

Provided is a fixing belt that is used in a fixing device, the fixing device nipping, between a heated fixing belt and a roller, a recording material in which an unfixed toner image is formed on a surface, and fixing the toner image onto the recording material, and the fixing belt has a fixing temperature that causes a tipping point in a characteristic of a change in glossiness of the toner image that has been fixed with respect to a change in the fixing temperature.

20 Claims, 8 Drawing Sheets

FIG. 9

| | MATERIAL OF ELASTIC LAYER | CHANGE IN INCLINATION OF GLOSSINESS | MINIMUM E'/ MAXIMUM E' | MAXIMUM GLOSSINESS AT 170°C OR LESS | E' AT 120°C | HARDNESS | GLOSSINESS | |
|---|---|---|---|---|---|---|---|---|
| | | | | | | | 170°C | 185°C |
| EXAMPLE 1 | SILICONE RUBBER A | 3.5 TIMES | 85% | 18 | 3.0E+06 | 12 | 18 | 40 |
| EXAMPLE 2 | SILICONE RUBBER B | 6.0 TIMES | 50% | 25 | 4.5E+06 | 20 | 25 | 42 |
| EXAMPLE 3 | SILICONE RUBBER C | 2.3 TIMES | 93% | 20 | 1.4E+06 | 8 | 20 | 37 |
| EXAMPLE 4 | SILICONE RUBBER D | 2.0 TIMES | 60% | 20 | 1.3E+06 | 5 | 20 | 30 |
| EXAMPLE 5 | SILICONE RUBBER E | 7.0 TIMES | 50% | 25 | 5.0E+06 | 20 | 25 | 35 |
| COMPARATIVE EXAMPLE 1 | SILICONE RUBBER F | NON | 47% | 20 | 1.2E+06 | 5 | 20 | 22 |
| COMPARATIVE EXAMPLE 2 | SILICONE RUBBER G | NON | 30% | 30 | 4.5E+06 | 30 | 30 | 45 |

FIXING BELT, FIXING DEVICE, IMAGE FORMING APPARATUS, AND IMAGE FORMING METHOD CAPABLE OF COPING WITH BOTH LOW GLOSSINESS AND HIGH GLOSSINESS

The entire disclosure of Japanese patent Application No. 2018-211584, filed on Nov. 9, 2018, is incorporated herein by reference in its entirety.

BACKGROUND

Technological Field

The present invention relates to a fixing belt that is used in a fixing device that fixes a toner image onto a surface of a recording material, a fixing device using the fixing belt, an image forming apparatus, and an image forming method.

Description of the Related Art

Conventionally, in an electrophotographic image forming apparatus such as a multifunction printer or a laser beam printer, after an image former forms an unfixed toner image on recording paper, a fixing device performs pressurizing and heating treatment on this recording paper so as to fix the toner image onto the recording paper. In general, a fixing device is used that includes a fixing roller, a heating roller that includes a heater, an endless annular fixing belt that is stretched around the fixing roller and the heating roller, and a pressure roller that is biased toward the fixing roller via the fixing belt. Recording paper is made to pass between the heated fixing belt, which rotates, and the pressure roller while being nipped, so that the toner image on the recording paper is fixed onto the recording paper.

One of the characteristics requested by a user from an output object of such an image forming apparatus is glossiness. In order to cope with a low glossiness and a high glossiness, a conventional image forming apparatus changes glossiness by being mounted with two fixing devices (see JP 2005-173259 A) or by being mounted with a plurality of pressure rollers and switching the plurality of pressure rollers (see JP 2010-211080 A).

However, there have been problems of an increase in mechanical complexity and size, an increase in a cost, and the like, if two fixing devices are equipped or a plurality of pressure rollers are provided to be switchable in order to cope with both a low glossiness and a high glossiness.

SUMMARY

The present invention has been made in order to solve the problems described above. It is an object of the present invention to provide a fixing belt, a fixing device, an image forming apparatus, and an image forming method that are capable of coping with both a low glossiness and a high glossiness without causing an increase in mechanical complexity and size.

To achieve the abovementioned object, according to an aspect of the present invention, there is provided a fixing belt that is used in a fixing device, and the fixing device nipping, between a heated fixing belt and a roller, a recording material in which an unfixed toner image is formed on a surface, and fixing the toner image onto the recording material, and the fixing belt reflecting one aspect of the present invention has a fixing temperature that causes a tipping point in a characteristic of a change in glossiness of the toner image that has been fixed with respect to a change in the fixing temperature.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 9 is a diagram illustrating various characteristics with regard to fixing belts in Examples 1 to 5 and Comparative Examples 1 and 2.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
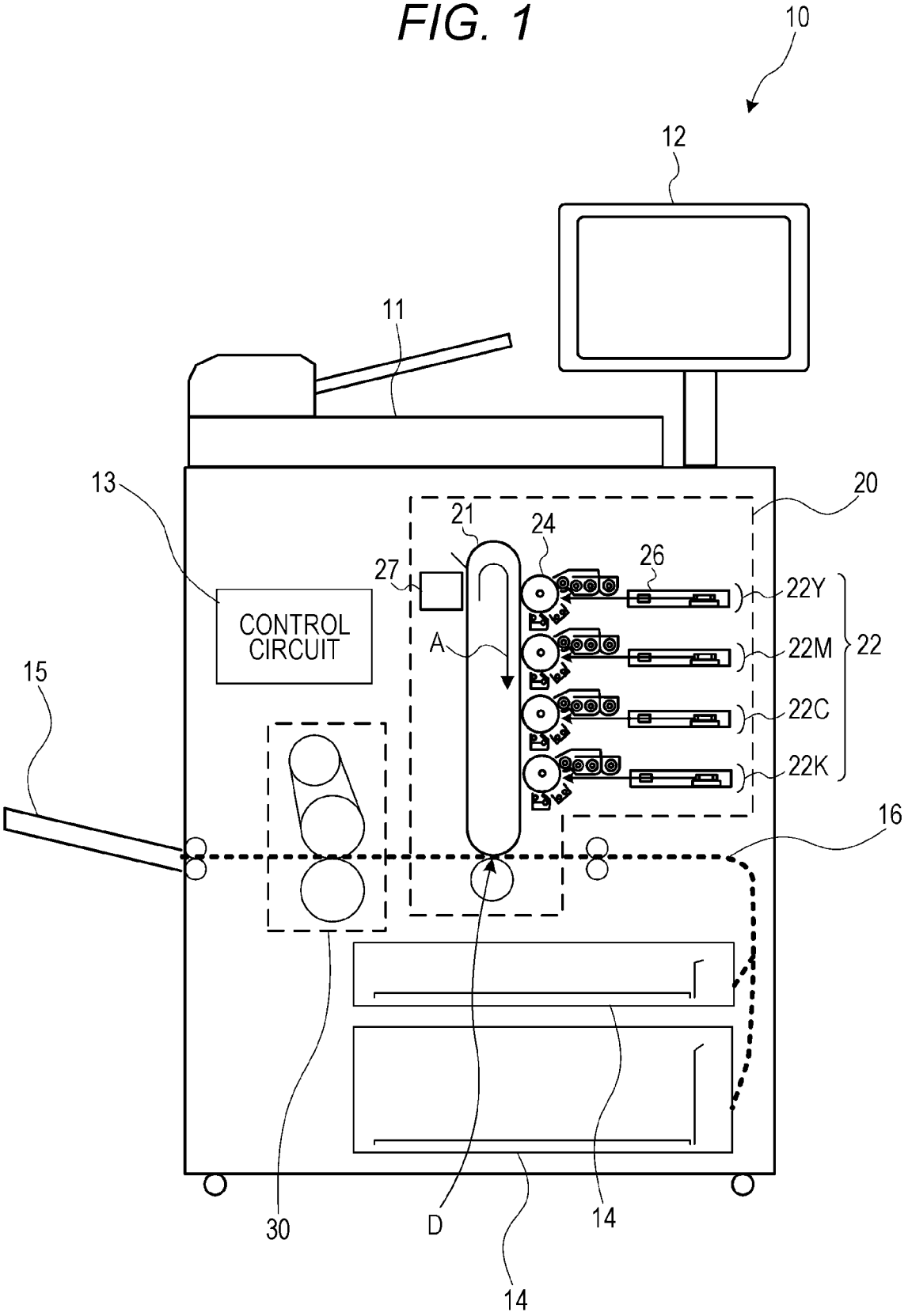
FIG. 1 is a diagram illustrating a schematic mechanical configuration of an image forming apparatus that includes a fixing device using a fixing belt according to an embodiment of the present invention.

FIG. 1 illustrates a schematic mechanical configuration of an image forming apparatus 10 that includes a fixing device using a fixing belt according to an embodiment of the present invention. The image forming apparatus 10 is what is called a multifunction printer that has a copying function of forming an image obtained by optically reading an original on a recording material such as recording paper and outputting the image, a printing function of forming, on printing paper, an image that has been rasterized on the basis of externally input printing data and outputting the image, and other functions. The recording material is not limited to recording paper, and may be a film, cloth, or the like. The description below is provided under the assumption that the recording material is recording paper.

The image forming apparatus 10 includes a scanner 11 that optically reads an original, an operation panel 12 that receives an operation performed by a user and displays various types of information, a control circuit 13 that controls an operation of the entirety of the apparatus or performs image processing, an image former 20 that forms an unfixed toner image on a recording material, a fixing device 30 that fixes the unfixed toner image on recording paper, a paper feeding tray 14 that can store many sheets of recording paper to be used in the formation of an image, a conveyor 16 that conveys a paper sheet delivered from the paper feeding tray 14, and the like.

The image former 20 is what is called an electrophotographic printing engine. The image former 20 includes an intermediate transfer belt 21 that is stretched in an endless annular manner and has a prescribed width, and image forming units 22Y, 22M, 22C, and 22K for respective colors, yellow (Y), magenta (M), cyan (C), and black (K), that each form a toner image having a single color component on the intermediate transfer belt 21. Here, toner is used that has a temperature ranging from 100° C. to 140° C. when a storage elastic modulus is $1\times10^4$ Pa. The toner may be a one-component developer or may be a two-component developer. Note that the image forming units 22Y, 22M, 22C, and 22K for the respective colors are collectively referred to as an image forming unit 22.

The image forming units 22Y, 22M, 22C, and 22K have the colors of toner to be used that are different from each other, but have the same structure. Each of the image forming units 22Y, 22M, 22C, and 22K includes a photoreceptor drum 24 having a cylindrical shape that serves as an electrostatic latent image carrier on the surface of which an electrostatic latent image is formed, and includes an electrifying device, a developing device, a transfer device, a photoreceptor cleaning device, and the like so as to be disposed around the photoreceptor drum 24. In addition, a print head 26 is included that includes a laser diode (LD) serving as a laser element, a polygon mirror, various lens, a mirror, and the like.

In each of the image forming units 22Y, 22M, 22C, and 22K, the photoreceptor drum 24 is driven by a not-illustrated drive unit so as to rotate in a given direction, the electrifying device uniformly electrifies the photoreceptor drum 24, and the print head 26 scans the photoreceptor drum 24 with a laser beam on which ON/OFF control has been performed in accordance with a drive signal based on image data having a corresponding color, and forms an electrostatic latent image on the surface of the photoreceptor drum 24.

The developing device performs a developing process for developing the electrostatic latent image on the surface of the photoreceptor drum 24 with toner and visualizing the electrostatic latent image. The toner image formed on the surface of the photoreceptor drum 24 is transferred to the intermediate transfer belt 21 in a portion in contact with the intermediate transfer belt 21. The photoreceptor cleaning device removes toner that remains on the surface of the photoreceptor drum 24 after transfer by scraping the toner using a blade or the like, and recovers the toner.

The intermediate transfer belt 21 winds around a plurality of rollers to be stretched around the plurality of rollers, and is driven by the drive unit so as to rotate in a direction of arrow A in the drawing. In a rotation process, toner images that have been formed on the photoreceptor drums 24 by the image forming units 22Y, 22M, 22C, and 22K for the respective colors are sequentially transferred on the intermediate transfer belt 21, are superimposed onto each other, and are synthesized so that a full-color image is generated on the intermediate transfer belt 21. This color image using toner is transferred onto the surface of recording paper from the intermediate transfer belt 21 in a secondary transfer position D (a transfer process). In addition, toner that remains on the intermediate transfer belt 21 is removed from the surface of the transfer belt 21 by the cleaning device 27 that is provided on a downstream side of the secondary transfer position D.

The fixing device 30 is provided on a downstream side of the secondary transfer position D in the middle of a conveyance path of the recording paper, and performs a fixing process for fixing, onto this recording material, the toner image that has been transferred onto the surface of the recording paper in the secondary transfer position D, by heating and pressing.

The conveyor 16 has a function of causing recording paper delivered from the paper feeding tray 14 to pass through the secondary transfer position D and the fixing device 30 and conveying the recording paper to an ejected paper tray 15. The conveyor 16 includes a conveyance roller and a guide that form the conveyance path, a motor that drives the conveyance roller, and the like. The conveyor 16 includes a paper reversing mechanism for duplex printing of reversing a front surface and a reverse surface of the recording paper that has gotten out of the fixing device 30 and delivering the recording paper to a conveyance path on an upstream side of the secondary transfer position D again, but this is not illustrated.

The control circuit 13 principally includes a central processing unit (CPU), a read-only memory (ROM) a random access memory (RAM), and the like. The CPU performs processing according to a program stored in the ROM, so that respective functions of the image forming apparatus 10 are achieved.

Figure 2:
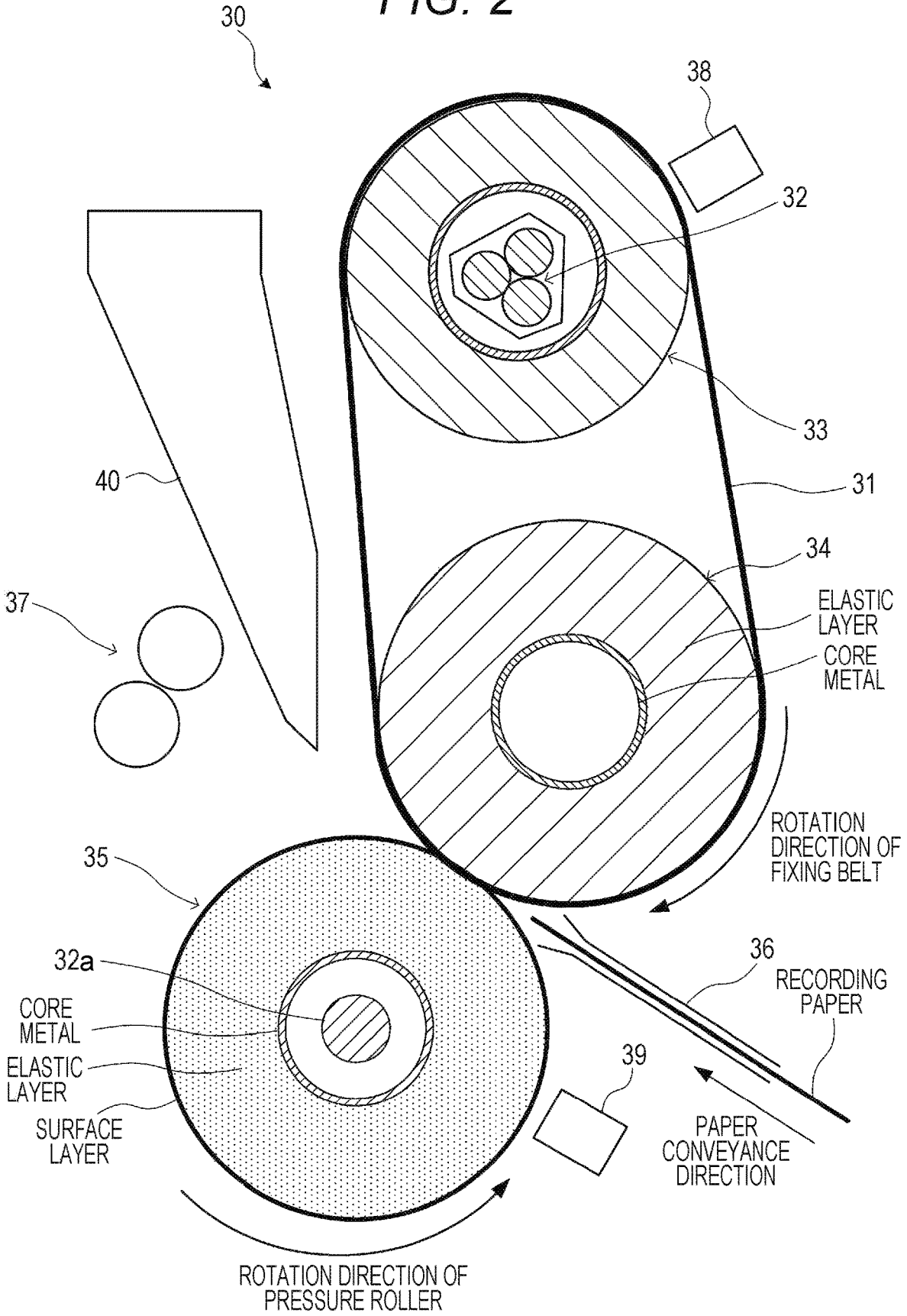
FIG. 2 is a diagram illustrating a schematic configuration of the fixing device.

FIG. 2 illustrates a schematic configuration of the fixing device 30. The fixing device 30 includes a fixing belt 31 having an endless annular shape, two or more rollers 33 and 34 that are disposed inside the fixing belt 31 and that the fixing belt 31 is stretched around, and a pressure roller 35 that is biased toward one of the rollers 33 and 34 via the fixing belt 31. Here, two or more rollers that are disposed inside the fixing belt 31 and that the fixing belt 31 is stretched around are a heating roller 33 that incorporates a heater 32 that heats the fixing belt 31, and a fixing roller 34. The pressure roller 35 is biased and pressed toward the fixing roller 34 with the fixing belt 31 sandwiched between the pressure roller 35 and the fixing roller 34. A portion in which the pressure roller 35 abuts onto the fixing belt 31 is referred to as a fixing nip part.

Further, the fixing device 30 includes: a guide plate 36 that guides recording paper conveyed by the conveyor 16, toward the fixing nip part (a portion between the pressure roller 35 and the fixing belt 31 that abut onto each other); a pair of delivery rollers 37 that deliver the recording paper that has passed through the fixing nip part to the outside of the fixing device 30; a first temperature sensor 38 that measures the temperature of the fixing belt 31; a second temperature sensor 39 that measures the temperature of an outer peripheral surface of the pressure roller 35; an air-flow separator 40 that applies an air flow toward the fixing nip part from a side of the delivery rollers 37 so as to prompt the separation of the recording paper from the fixing belt 31; and the like.

The fixing belt 31 is stretched around the heating roller 33 and the fixing roller 34 so as to include the heating roller 33 and the fixing roller 34. The heating roller 33 is formed in such a way that the heater 32 is disposed in a cylindrical core metal that is hollow in a center part and is made of aluminum, iron, stainless steel (SUS), or the like. Similarly, the pressure roller 35 is hollow in a center part, and a heater 32A is disposed in the hollow center part. Here, a halogen lamp is used as the heater 32 and 32A, but this is not restrictive.

The heating roller 33 is driven by a not-illustrated motor so as to rotate, and thus, the fixing belt 31 rotates, and the fixing roller 34 rotates following the movement of the fixing belt 31. The pressure roller 35 is pressed onto the fixing roller 34 with the fixing belt 31 sandwiched between the pressure roller 35 and the fixing roller 34 at least during the passage of paper. The recording paper passes through the fixing nip part in which the pressure roller 35 and the fixing belt 31 are in contact with each other, while being nipped between the pressure roller 35 and the fixing belt 31. At this time, a toner image on the recording paper is fixed onto the recording paper by being heated and pressed.

Figure 3:
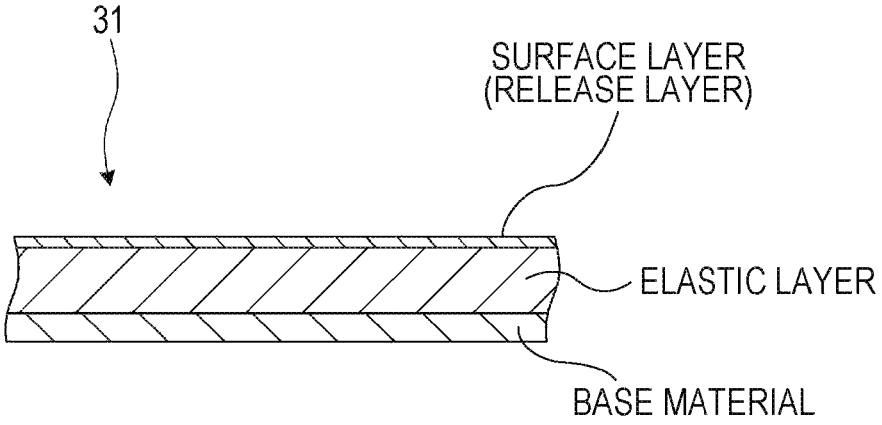
FIG. 3 is a diagram illustrating a laminated structure of the fixing belt.

The fixing belt 31 is formed in such a way that an elastic layer made of silicone rubber or the like is stacked on a base material made of polyimide resin (PI) or the like and a surface layer (a release layer) made of a polytetrafluoroethylene (trifluoroethylene resin) (PFA) tube or the like is stacked on the elastic layer (see FIG. 3).

The fixing roller 34 includes a hollow cylindrical core metal that is formed by aluminum, iron, stainless steel (SUS), or the like, and silicone rubber or silicone sponge that forms an elastic layer around the core metal.

The pressure roller 35 includes a hollow cylindrical core metal that is formed by aluminum, iron, SUS, or the like, an elastic layer that is made of silicone rubber or the like around the core metal, and a surface layer that is made of a PFA tube or the like that is formed on the elastic layer.

The image forming apparatus 10 according to the present embodiment switches the glossiness of the toner image on the recording paper that has been fixed by the fixing device 30 between a low glossiness and a high glossiness, by changing the fixing temperature of the fixing device 30 within a range of about 15° C. Specifically, as a fixing belt to be used in the fixing device 30, a belt is used that has a fixing temperature that causes a tipping point in the characteristic of a change in the glossiness of a fixed toner image with respect to a change in fixing temperature (the temperature of the fixing belt 31) (referred to as a fixing temperature-glossiness characteristic). The tipping point is a point at which something that has been changing slightly changes suddenly and rapidly. Here, the tipping point is a fixing temperature having a threshold that causes a sudden increase in a rate of a change in the glossiness of a fixed toner image with respect to a change in fixing temperature. More specifically, a fixing temperature before and after which a rate of a change of the glossiness of a fixed toner image with respect to a change in fixing temperature changes by 2 times or more is set to be a tipping point, and a fixing belt 31 is used that has such a fixing temperature-glossiness characteristic.

Figure 4:
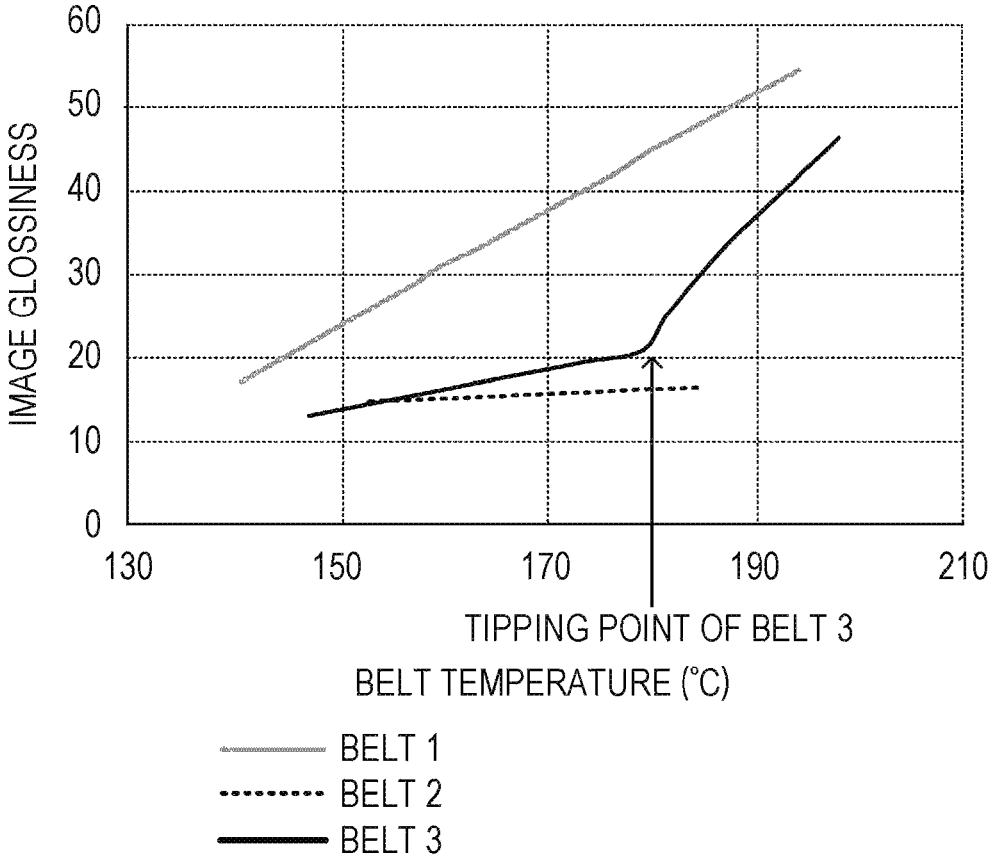
FIG. 4 is a diagram illustrating, with regard to a plurality of fixing belts, a relationship between fixing temperature (the temperature of the fixing belt) and the glossiness of a toner image on recording paper that has been fixed by the fixing device.

FIG. 4 illustrates, with regard to a plurality of fixing belts, a relationship between fixing temperature (the temperature of the fixing belt 31) and the glossiness (referred to as image glossiness) of a toner image on recording paper that has been fixed by the fixing device 30. Belt 1 is a fixing belt that is conventionally used to obtain a high glossiness, and Belt 2 is a fixing belt that is conventionally used to obtain a low glossiness. Belt 3 is a fixing belt according to an embodiment of the present invention that has the tipping point described above.

In the case of Belt 1, when fixing temperature is changed from about 140° C. to about 210° C., glossiness increases according to an increase in the fixing temperature, but a rate of a change in the glossiness with respect to a change in the fixing temperature is almost constant. Therefore, in order to switch image glossiness between a low glossiness and a high glossiness by changing the fixing temperature, it is requested that the fixing temperature be changed by about 50° C. to be, for example, 140° C. or 190° C. In addition, a lower limit fixing temperature for appropriately fixing toner is about 160° C. Therefore, in the case of Belt 1, an image glossiness at 160° C. is already near a high-glossiness area. Thus, even if the fixing temperature is changed within a temperature range that can be used as fixing temperature (referred to as a fixing temperature range; approximately from 160° C. to 210° C.), the image glossiness only changes within the high-glossiness area, and the image glossiness fails to be switched between a low glossiness and a high glossiness. Stated another way, if Belt 1 is used as a fixing belt, the image glossiness is always a high glossiness in the fixing temperature range.

In the case of Belt 2, even if fixing temperature is changed from about 150° C. to about 190° C., image glossiness hardly changes. Stated another way, if Belt 2 is used as a fixing belt, the image glossiness is always a low glossiness in the fixing temperature range.

Belt 3 has a tipping point near 180° C. Stated another way, near 180° C., a rate of a change in image glossiness with respect to a change in fixing temperature suddenly changes, and the rate of a change in image glossiness with respect to a change in fixing temperature changes by 2 times or more before and after the tipping point. Stated another way, if Belt 3 is used as a fixing belt, the image glossiness can be switched between a low glossiness and a high glossiness by simply changing the fixing temperature by about 15° C. within the fixing temperature range.

Figure 5:
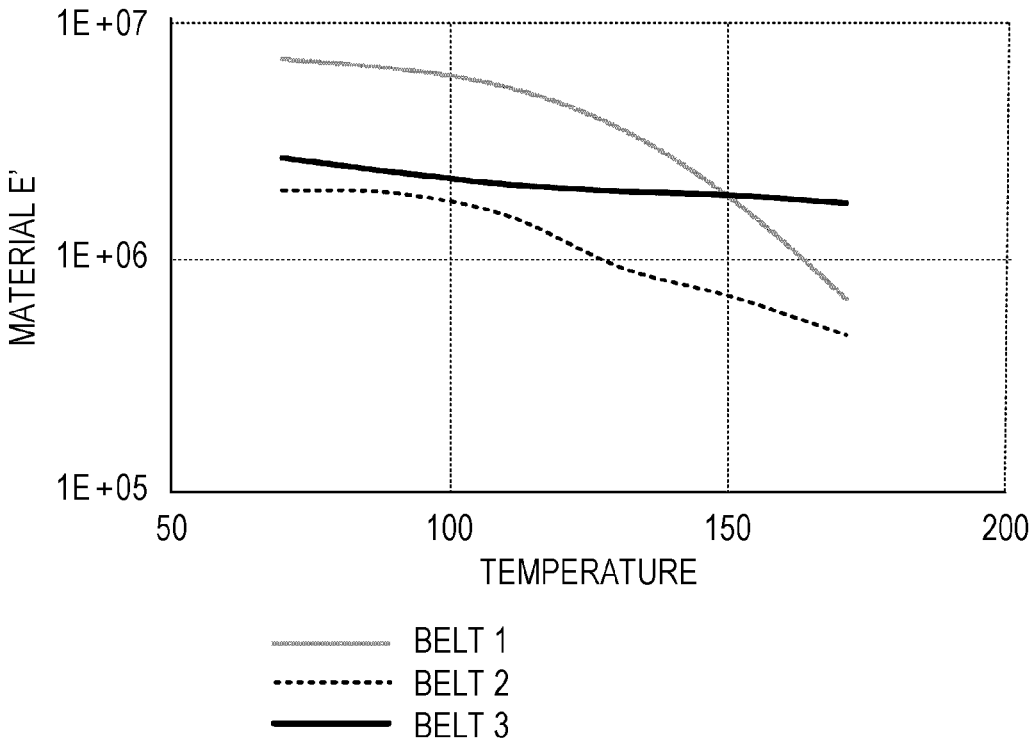
FIG. 5 is a diagram illustrating the characteristic of a change in a storage elastic modulus with respect to temperature with regard to a material that forms an elastic layer of Belt 1, 2, or 3 of FIG. 4.

FIG. 5 illustrates the characteristic of a change in a storage elastic modulus with respect to temperature with regard to an elastic material that forms an elastic layer of Belt 1, 2, or 3. In the case of Belt 1 for which image glossiness is always a high glossiness in a fixing temperature range (160° C. to 210° C.), a storage elastic modulus significantly decreases during an increase in temperature from 100° C. to 170° C., and in a temperature range from 100° C. to 170° C., a ratio of a minimum value to a maximum value of the storage elastic modulus is 30% or less. In the case of Belt 2, a storage elastic modulus significantly decreases during an increase in temperature from 100° C. to 170° C., and in a temperature range from 100° C. to 170° C., a ratio of a minimum value to a maximum value of the storage elastic modulus is 47% or less.

In the case of Belt 3, a storage elastic modulus hardly decreases even during an increase in temperature from 100° C. to 170° C., and in a temperature range from 100° C. to 170° C., a ratio of a minimum value to a maximum value of the storage elastic modulus is about 85%.

If an elastic material that has a small change in a storage elastic modulus with respect to a change in temperature, such as an elastic material of Belt 3, is used for an elastic layer of a fixing belt, image glossiness can be switched between a low glossiness and a high glossiness by slightly changing fixing temperature. A reason for this is estimated as described below.

Figure 6A:
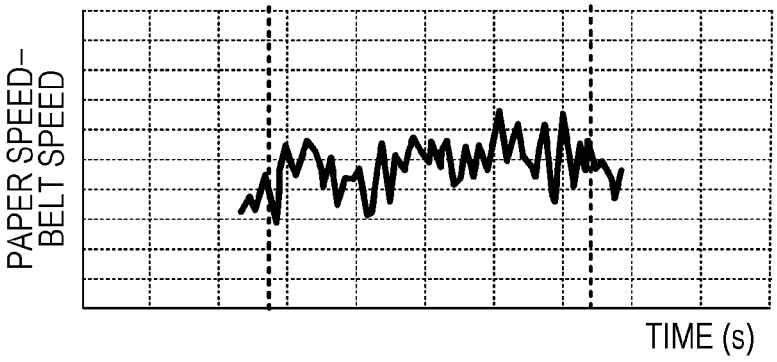
FIGS. 6A and 6B are graphs illustrating a difference between the conveyance speed of recording paper and the movement speed of a fixing belt during a period during which a specified portion of the recording paper passes through a fixing nip part.
Figure 6B:
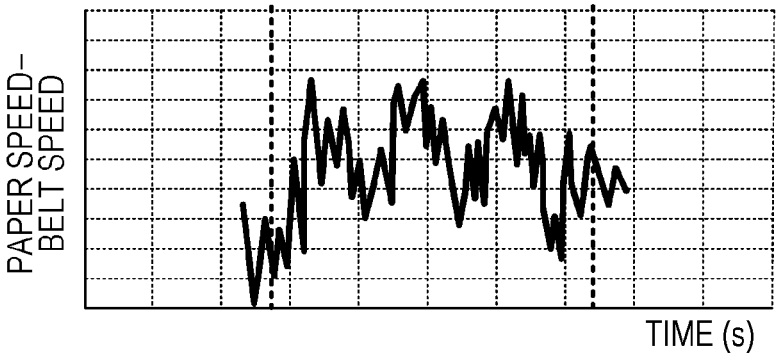

FIGS. 6A and 6B are graphs illustrating a difference between the conveyance speed of recording paper and the movement speed of a fixing belt during a period during which a specified portion of the recording paper passes through the fixing nip part. FIG. 6A is a graph in a case where Belt 2 that copes with a low glossiness is used, and FIG. 6B is a graph in a case where Belt 1 that copes with a high glossiness is used.

As illustrated in FIG. 6A, in a case where Belt 2 that copes with a low glossiness is used, there is almost no difference in speed between recording paper and a fixing belt while a specified portion of the recording paper passes through the fixing nip part, and a slide between toner on the recording paper and the fixing belt is small. Stated another way, the fixing belt simply presses the toner toward the recording paper, and has a small movement of rubbing the toner.

In contrast, as illustrated in FIG. 6B, in a case where Belt 1 that copes with a high glossiness is used, there is a large difference in speed between recording paper and a fixing belt while a specified portion of the recording paper passes through the fixing nip part, and a slide is generated between toner on the recording paper and the fixing belt. Stated another way, it can be considered that a shearing force acts between the toner and the fixing belt, the toner is extended, and this results in an increase in glossiness.

In a case where Belt 3 according to an embodiment of the present invention is used, it can be considered from the above that, in a temperature range having a temperature that is lower than or equal to a fixing temperature at a tipping point, there is almost no difference in speed between recording paper and a fixing belt when the recording paper passes through the fixing nip part, and a slide between toner on the recording paper and the fixing belt is small. It can also be considered that, when the temperature exceeds the fixing temperature at the tipping point, the toner is further melt due to an increase in temperature, and this causes a large difference in speed between the recording paper and the fixing belt, and a slide occurs.

Figure 7:
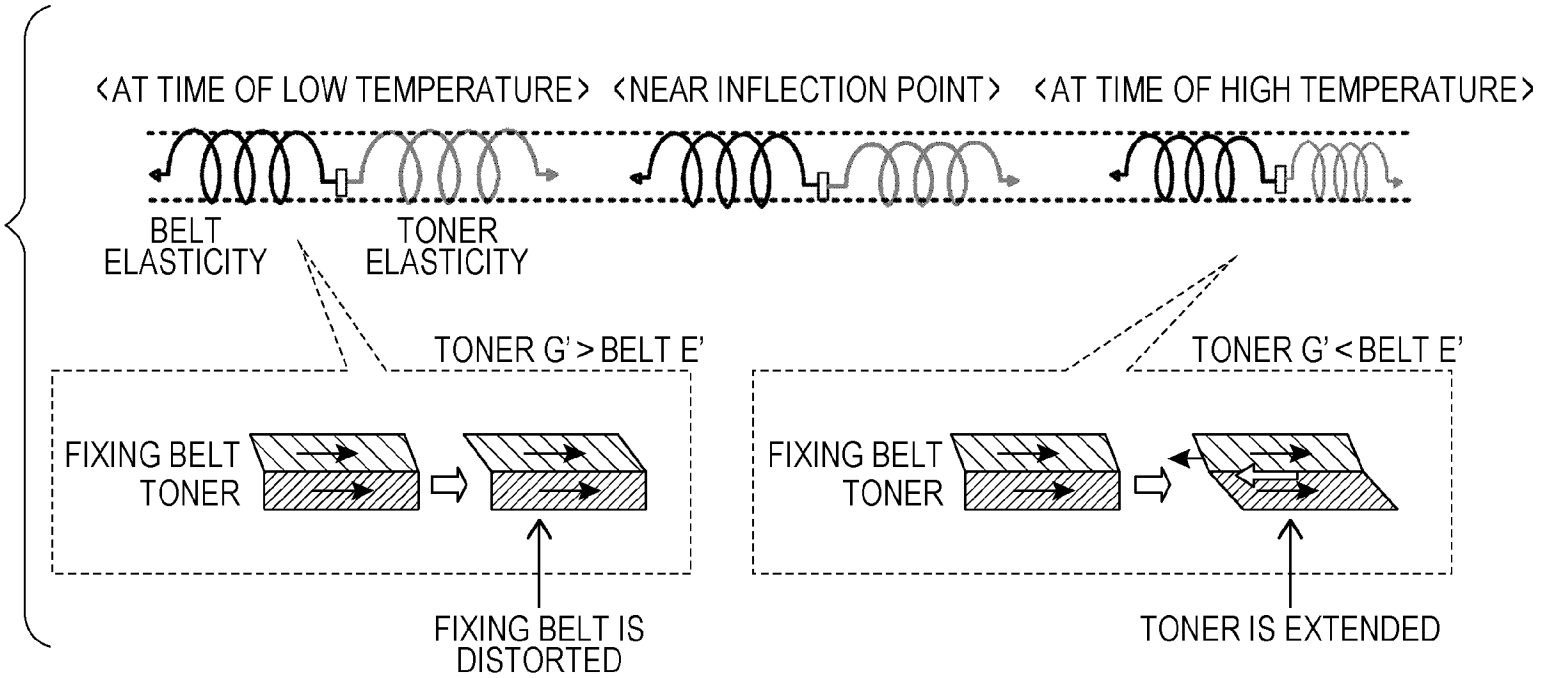
FIG. 7 is a diagram illustrating a relationship between a fixing belt and toner by imagining the mutual pulling of springs.

It is imagined that a spring of a fixing belt (Belt 3) and a spring of toner pull each other, as illustrated in FIG. 7. When the strength of the spring of the fixing belt (in particular a portion of an elastic layer) is compared with the strength of the spring of the toner, the spring of the toner is stronger at the time of a low temperature. Therefore, the fixing belt is distorted, and the toner is not extended and is fixed. When the temperature increases, normally, the strengths of both springs decrease. However, in the case of Belt 3, even when the temperature increases, the storage elastic modulus hardly decreases. Therefore, when the temperature exceeds a certain fixing temperature (a fixing temperature at a tipping point), a magnitude relationship in strength between the spring of the fixing belt (in particular, a portion of the elastic layer) and the spring of the toner is reversed, and the toner is extended.

Figure 8:
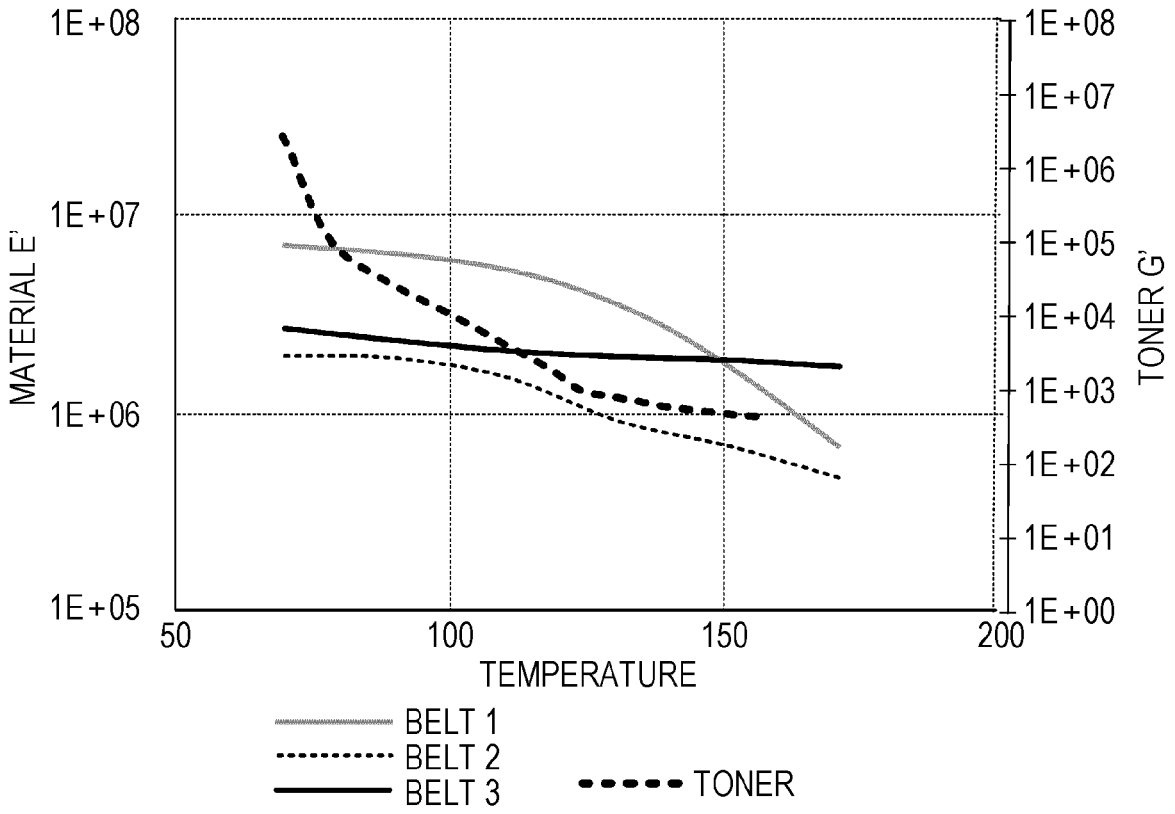
FIG. 8 is a diagram illustrating the characteristic of a change in a storage elastic modulus with respect to temperature with regard to elastic materials that form the elastic layers of fixing belts and toner in comparison with each other.

A phenomenon in which a magnitude relationship in the strength of a spring is reversed due to temperature can also be described from FIG. 8 illustrating the characteristic of a change in a storage elastic modulus G' of toner with respect to temperature and the characteristic of a change in a storage elastic modulus E' of a fixing belt with respect to temperature in comparison with each other. Specifically, the storage elastic modulus G' of toner significantly decreases according to an increase in temperature, but the storage elastic modulus E' of Belt 3 according to an embodiment of the present invention hardly decreases even when the temperature increases. Therefore, a magnitude relationship that storage elastic modulus G' of toner>storage elastic modulus E' of fixing belt in a temperature range having a temperature that is lower than a temperature at the tipping point is reversed to a magnitude relationship that storage elastic modulus G' of toner<storage elastic modulus E' of fixing belt in a temperature range having a temperature that is higher than or equal to the temperature at the tipping point.

In contrast, in the cases of conventional Belts 1 and 2, a storage elastic modulus E' decreases according to an increase in temperature similarly to the storage elastic modulus of toner. Therefore, a phenomenon in which a magnitude relationship with the storage elastic modulus G' of toner is reversed does not occur in contrast to Belt 3.

EXAMPLES

Next, various examples of a fixing belt according to an embodiment of the present invention are described.

FIG. 9 illustrates various characteristics with regard to fixing belts in Examples 1 to 5 and Comparative Examples 1 and 2. Comparative Example 1 is Belt 2 described above (a belt that copes with a low glossiness), and Comparative Example 2 is Belt 1 described above (a belt that copes with a high glossiness).

Production of Fixing Belt in Example 1

A fixing belt in Example 1 was produced as follows. A cylindrical core metal that has an outer diameter of 99 mm and is made of stainless steel was adhered to the inside of a belt base material that has an inner diameter of 99 mm, a length of 360 mm, and a thickness of 70 μm and is made of thermosetting polyimide resin. Next, a cylindrical mold that holds a PFA tube having a thickness of 30 μm on an inner peripheral surface was covered outside the belt base material so that the core metal and the cylindrical mold were coaxially held, and a cavity was formed between the core metal and the cylindrical mold. Then, silicone rubber material A was poured into this cavity, and was heated and cured, and an elastic layer was produced that has a thickness of 250 μm and is made of silicone rubber A (an elastic layer material). By doing this, the fixing belt in Example 1 was produced in which a base layer (the belt base material), an elastic layer made of silicone rubber A, and a surface layer (a release layer) made of PFA are superimposed in this order.

Note that silicone rubber material A is composition 370% obtained by mixing 100 parts by weight of dimethylpolysiloxane having a vinyl group as a side chain, 3 parts by weight of hydroxy group-containing dimethylpolysiloxane serving as a crosslinking agent, and 35 parts by weight in total of silica and alumina that have two types of particle size, and a thermal conductivity is 0.6 W/m·K.

The rubber hardness of silicone rubber A was measured according to JIS K 6301 by durometer A, by using a rubber sheet for measurement having a thickness of 2.0 mm.

Production of Fixing Belt in Other Examples and Comparative Examples

Fixing belts in the other examples and the comparative examples were produced similarly to the fixing belt in Example 1, excluding the changing of silicone rubber A to be used in the elastic layer to other silicone rubbers B to G. Silicone rubbers B to G are similar to silicone rubber A excluding the type of dimethylpolysiloxane having a vinyl group as a side chain, and the adjustment of a ratio of mixing a plurality of materials, an addition amount of an additive, and the like.

Measurement Conditions

Measurement conditions in obtaining the data illustrated in FIG. 9 are described below. Two fixing temperatures to be used in order to switch glossiness were assumed to be 170° C. and 185° C.

As recording paper, POD gloss coat 128 g/m$^2$ of A4 size from Oji Paper Co., Ltd. was used.

By using the image forming apparatus 10 in which a desired fixing belt has been attached to the fixing device 30, the recording paper was conveyed in a vertical direction at a speed of 65 sheets/minute, and an output object was generated. In the output object, an image is formed in which each attached amount of two red layers of magenta and yellow, two blue layers of magenta and cyan, and two green layers of cyan and yellow is 7.0 g/m$^2$. Toner was used that has a temperature ranging from 100° C. to 140° C. when a storage elastic modulus is $1\times10^4$ Pa. A glossiness at 60° in each of the areas of red, blue, and green on the output object was measured by using a glossmeter, and a mean value of these was obtained as the glossiness of the output object.

It is assumed that a glossiness of 35 or more (preferably, 40) is a high glossiness and a glossiness of 30 or less (preferably, 25 or less) is a low glossiness. It is assumed that it is requested that a difference between a low glossiness and a high glossiness be at least 10 or more and it is desirable that the difference be 15 or more. In addition, if a difference in glossiness is 10 or 15 or more but the difference has only been generated in an area that a person thinks that has a high glossiness, it cannot be said that a low glossiness and a high glossiness are switched. Accordingly, it is assumed that a glossiness at a lower end temperature (in this example, 170° C.) of a temperature range in which a difference in glossiness of 10 or 15 or more has been generated and a difference in temperature is 15 is within a low-glossiness area, and in other words, the glossiness is 30 or less, preferably, 25 or less.

Evaluation of Glossiness or the Like

According to the data of FIG. 9, with regard to respective fixing belts in Examples 1 to 5, the glossiness of an output object is changed to a low glossiness and a high glossiness by changing the fixing temperature to 170° C. and 185° C. In contrast, in Comparative Example 1, an output object has a low glossiness at both fixing temperatures of 170° C. and 185° C., and in Comparative Example 2, an output object has a high glossiness at both fixing temperatures of 170° C. and 185° C. As described above, in Comparative Examples 1 and 2, even if the fixing temperature is changed to 170° C. and 185° C., the glossiness of an output object fails to be switched to a low glossiness and a high glossiness.

In Examples 1 to 5, a ratio of a change in the glossiness of an output object with respect to a change in fixing temperature (a change in the inclination of glossiness) falls within a range of 2 times to 7 times, and the fixing belts in Examples 1 to 5 have a fixing temperature before and after which a ratio of a change in the glossiness of an output object with respect to a change in fixing temperature changes by 2 times or more (a fixing temperature that causes a tipping point). Comparative Examples 1 and 2 do not have such a fixing temperature.

In Examples 1 to 5, a difference in temperature of 15° C. between fixing temperatures of 170° C. and 185° C. causes a difference in glossiness of 10 or more, and a glossiness at a lower end temperature (170° C.) of a temperature range where the difference in temperature of 15° C. causes the difference in glossiness of 10 or more is 25 or less. In other words, glossiness monotonically increases according to an increase in temperature, and therefore, in a case where the fixing belts in Examples 1 to 5 are used, a maximum glossiness in a fixing temperature range of 170° C. or less is 25 or less, and stated another way, the maximum glossiness falls within a range that a person thinks that has a low glossiness.

In the fixing belts in Examples 1 to 5, a ratio of a minimum value to a maximum value (MinE'/MaxE') of a storage elastic modulus at 100° C. to 170° C. of an elastic material that forms an elastic layer of each of the fixing belts is 50% or more. In contrast, in the fixing belts in Comparative Examples 1 and 2, the ratio is less than 50%.

Note that, in Example 1 and Example 3 in which glossiness remarkably changes according to a change in fixing temperature, the ratio described above is 80% or more.

In addition, according to a storage elastic modulus E' at 120° C. that is illustrated in FIG. 9, in the fixing belts in Examples 1 to 5 in which a small change in fixing temperature enables the glossiness of an output object to be switched to a high glossiness and a low glossiness, a storage elastic modulus at 120° C. of an elastic material that forms an elastic layer of each of the fixing belts ranges from 1.3E+06 to 4.5E+06.

In addition, as illustrated in FIG. 9, the hardness of an elastic material that forms an elastic layer of each of the fixing belts in Examples 1 to 5 ranges from 5 to 20.

As described above, by using a fixing belt that has a fixing temperature that causes a tipping point (a change point at which a small change is changed to a sudden increase) in the characteristic of a change in the glossiness of a fixed toner image with respect to a change in fixing temperature, the glossiness of an output object can be switched to a high glossiness and a low glossiness by changing the fixing temperature within a small range (a range of about 10° C. to 15° C.) that includes the tipping point, and an output object having a low glossiness and an output object having a high glossiness can be obtained by using one fixing belt without causing an increase in mechanical complexity and size as in a conventional technique.

Although embodiments of the present invention have been described and illustrated in detail with reference to the drawings, a specific configuration described in the disclosed embodiments is made for purposes of illustration and example only and not limitation, and changes or additions without departing from the gist of the present invention would be included in the present invention. The scope of the present invention should be interpreted by terms of the appended claims.

What is claimed is:

1. A fixing belt that is used in a fixing device, the fixing device nipping, between a heated fixing belt and a roller, a recording material in which an unfixed toner image is formed on a surface, and fixing the toner image onto the recording material, wherein the fixing belt has a fixing temperature that causes a tipping point in a characteristic of a change in glossiness of the toner image that has been fixed with respect to a change in the fixing temperature.

2. The fixing belt according to claim 1, wherein a difference between a maximum value and a minimum value of the glossiness in any temperature range having a difference in temperature of 15° C. within a range of the fixing temperature of 160° C. to 210° C. is 10 or more, and the glossiness at the fixing temperature at a lower end of the any temperature range is 30 or less.

3. The fixing belt according to claim 2, wherein the difference between the maximum value and the minimum value of the glossiness is 15 or more rather than 10 or more.

4. The fixing belt according to claim 1, wherein a difference between a maximum value and a minimum value of the glossiness in any temperature range having a difference in temperature of 15° C. within a range of the fixing temperature of 160° C. to 210° C. is 10 or more, and the glossiness at the fixing temperature at a lower end of the any temperature range is 25 or less.

5. The fixing belt according to claim 1, wherein at least an elastic layer is included, and a ratio of a minimum value to a maximum value of a storage elastic modulus at 100° C. to 170° C. of an elastic material is 50% or more, the elastic material forming the elastic layer.

6. The fixing belt according to claim 1, wherein at least an elastic layer is included, and a ratio of a minimum value to a maximum value of a storage elastic modulus at 100° C. to 170° C. of an elastic material is 80% or more, the elastic material forming the elastic layer.

7. The fixing belt according to claim 1, wherein an elastic layer that is made of an elastic material and a release layer are stacked in this order on a base layer that is made of heat-resistant resin.

8. The fixing belt according to claim 1, wherein at least an elastic layer is included, and a storage elastic modulus at 120° C. of an elastic material that forms the elastic layer falls within a range of 1.3E+06 to 4.5E+06.

9. The fixing belt according to claim 1, wherein at least an elastic layer is included, and a hardness of an elastic material that forms the elastic layer falls within a range of 5 to 20.

10. A fixing device comprising:

the fixing belt according to claim 1 that has an endless annular shape;

two or more rollers that are disposed inside the fixing belt, the fixing belt being stretched around the two or more rollers, the two or more rollers including a heating roller, the heating roller incorporating a heater that heats the fixing belt; and a pressure roller that is biased toward one of the two or more rollers via the fixing belt.

11. An image forming apparatus comprising:

an image former that forms an unfixed toner image on a surface of a recording material; and the fixing device according to claim 10 that fixes the unfixed toner image onto the recording material.

12. An image forming method comprising:

developing an electrostatic latent image with toner, the electrostatic latent image being formed on a photoreceptor;

transferring a toner image onto a surface of a recording material, the toner image being formed on the photoreceptor; and fixing, onto the recording material, the toner image that has been transferred onto the surface of the recording material, wherein toner having a temperature ranging from 100° C. to 140° C. when a storage elastic modulus is $1\times10^4$ Pa is used as the toner, and the fixing belt according to claim 1 is used in the fixing.

13. A fixing belt that is used in a fixing device, the fixing device nipping, between a heated fixing belt and a roller, a recording material in which an unfixed toner image is formed on a surface, and fixing the toner image onto the recording material, wherein the fixing belt has a fixing temperature before and after which a ratio of a change in glossiness of the toner image that has been fixed with respect to a change in the fixing temperature changes by two times or more.

14. The fixing belt according to claim 13, wherein a difference between a maximum value and a minimum value of the glossiness in any temperature range having a difference in temperature of 15° C. within a range of the fixing temperature of 160° C. to 210° C. is 10 or more, and the glossiness at the fixing temperature at a lower end of the any temperature range is 30 or less.

15. The fixing belt according to claim 13, wherein a difference between a maximum value and a minimum value of the glossiness in any temperature range having a difference in temperature of 15° C. within a range of the fixing temperature of 160° C. to 210° C. is 10 or more, and the glossiness at the fixing temperature at a lower end of the any temperature range is 25 or less.

16. The fixing belt according to claim 13, wherein at least an elastic layer is included, and a ratio of a minimum value to a maximum value of a storage elastic modulus at 100° C. to 170° C. of an elastic material is 50% or more, the elastic material forming the elastic layer.

17. The fixing belt according to claim 13, wherein at least an elastic layer is included, and a ratio of a minimum value to a maximum value of a storage elastic modulus at 100° C. to 170° C. of an elastic material is 80% or more, the elastic material forming the elastic layer.

18. The fixing belt according to claim 13, wherein at least an elastic layer is included, and a storage elastic modulus at 120° C. of an elastic material that forms the elastic layer falls within a range of 1.3E+06 to 4.5E+06.

19. The fixing belt according to claim 13, wherein at least an elastic layer is included, and a hardness of an elastic material that forms the elastic layer falls within a range of 5 to 20.

20. An image forming method comprising:

developing an electrostatic latent image with toner, the electrostatic latent image being formed on a photoreceptor;

transferring a toner image onto a surface of a recording material, the toner image being formed on the photoreceptor; and fixing, onto the recording material, the toner image that has been transferred onto the surface of the recording material, wherein toner having a temperature ranging from 100° C. to 140° C. when a storage elastic modulus is $1\times10^4$ Pa is used as the toner, and the fixing belt according to claim 13 is used in the fixing.

* * * * *